US009115943B1

(12) United States Patent
Jordan

(10) Patent No.: US 9,115,943 B1
(45) Date of Patent: Aug. 25, 2015

(54) APPARATUS FOR FACILITATING RAPID LOADING OF CARTRIDGES INTO A FIREARM MAGAZINE

(71) Applicant: Andrew R. Jordan, Memphis, TN (US)

(72) Inventor: Andrew R. Jordan, Memphis, TN (US)

( * ) Notice: Subject to any disclaimer, the term of this patent is extended or adjusted under 35 U.S.C. 154(b) by 0 days.

(21) Appl. No.: 14/220,304

(22) Filed: Mar. 20, 2014

(51) Int. Cl.
*F41A 9/84* (2006.01)
*F41A 9/83* (2006.01)

(52) U.S. Cl.
CPC ..... *F41A 9/83* (2013.01)

(58) Field of Classification Search
CPC ..... F41A 9/83; F41A 9/84
USPC ..... 42/87–89
See application file for complete search history.

(56) References Cited

U.S. PATENT DOCUMENTS

| | | | | | |
|---|---|---|---|---|---|
| 1,379,075 | A * | 5/1921 | Ashworth | 42/88 |
| 3,032,907 | A * | 5/1962 | Parker | 42/88 |
| 5,417,003 | A * | 5/1995 | Claveau | 42/90 |
| 6,185,853 | B1 * | 2/2001 | Sniezak et al. | 42/87 |
| 7,364,057 | B2 * | 4/2008 | Carroll | 224/196 |
| 8,915,007 | B1 * | 12/2014 | Williams | 42/88 |
| 2009/0044440 | A1 * | 2/2009 | Tal et al. | 42/87 |

* cited by examiner

*Primary Examiner* — Michael David

(57) ABSTRACT

An apparatus for facilitating rapid loading of cartridges into a firearm magazine includes a curved outer strip and a curved inner strip. The curved outer strip and the curved inner strip are adjacently connected to the each other, where the curved inner strip is positioned within the curved outer strip. Users can load rifle cartridges into a pair of recess tracks as the pair of recess tracks is formed by the curved outer strip and the curved inner strip. Then the rifle cartridges are manually loaded into the firearm magazine from the curved outer strip and the curved inner strip.

16 Claims, 11 Drawing Sheets

APPARATUS FOR FACILITATING RAPID LOADING OF CARTRIDGES INTO A FIREARM MAGAZINE

The current application claims a priority to the U.S. Provisional Patent application Ser. No. 61/803,580 filed on Mar. 20, 2013.

FIELD OF THE INVENTION

The present invention relates generally to firearm accessories. More specifically, the present invention is a stripper clip for facilitating rapid loading of cartridges into firearm magazines.

BACKGROUND OF THE INVENTION

The most common type of magazine utilized by modern handguns, rifles, and other firearms is the box magazine. Internal box magazines are integrated into firearms for loading with cartridges. Detachable box magazines, as their name suggests, are loaded with cartridges and attached to firearms. The magazines are then removed when empty. Box magazines are generally loaded with cartridges in two distinct configurations. Single column type magazines hold cartridges one above the other in a single stack. Double column or double stack type magazines hold cartridges in a staggered zigzag stack. Although box magazines allow users to fire multiple shots without reloading, the loading process for the box magazines is time-consuming if individual cartridges are loaded one at a time into the magazines. High spring pressure forcing loaded cartridges to the top of a magazine is problematic as well. Stripper clips are employed in order to speed load cartridges into a box magazine, often five or ten at a time. In general, stripper clips are thin rail brackets that are designed to hold a number of cartridges and are inserted into a firearm magazine. During use, a stripper clip is inserted into a slot in the magazine and pressure is manually applied to the cartridges from above. The applied pressure causes the cartridges to slide down the rail of the stripper clip and into the magazine. In order to facilitate loading, stripper clips are used in conjunction with guide tools that decrease the amount of pressure required to insert sequential cartridges into the magazine. The present invention seeks to enhance and improve upon currently existing stripper clips used for speed loading.

The present invention is a stripper clip that is used to facilitate the rapid loading of cartridges into a firearm box magazine. In its preferred embodiment, the present invention comprises an inner strip and an outer strip. The outer strip forms a rail into which the inner strip is inserted and wedged in place. The outer strip is sized to accommodate the rim of a cartridge. In the preferred embodiment of the present invention, the stripper clip is designed and sized for use with 5.56×45 mm NATO rifle cartridges and Draft Standardization Agreement (STANAG) magazines. The inner strip features two extruded tabs present at both the first and second ends of the stripper clip. The tabs aid in preventing cartridges from slipping out of the rail of the stripper clip.

In the preferred embodiment of the present invention, the stripper clip is capable of holding one to fifteen 5.56×45 mm NATO rifle cartridges. Prior to use, the user slots cartridges into the rail of the outer clip. The rail of the outer clip holds the cartridges in place and allows the cartridges to move along the length of the stripper clip. After the cartridges are in place, a guide tool is slotted onto a STANAG magazine. The stripper clip is slotted into the rail of the guide tool and is positioned in a manner such that the cartridges may be loaded correctly into the magazine. The user applies pressure to the cartridges in a downward direction which in turn slides the cartridges along the rail of the stripper clip and into the magazine. After the final cartridge has been loaded, the stripper clip and guide tool are removed from the magazine. The two lengthy parallel edges of the outer strip each feature two raised bumps. Each bump is spaced equally from both the first end and the second end of the outer strip. The bumps limit the depth to which the stripper clip may insert into the guide tool.

DETAIL DESCRIPTIONS OF THE INVENTION

All illustrations of the drawings are for the purpose of describing selected versions of the present invention and are not intended to limit the scope of the present invention.

Figure 1:
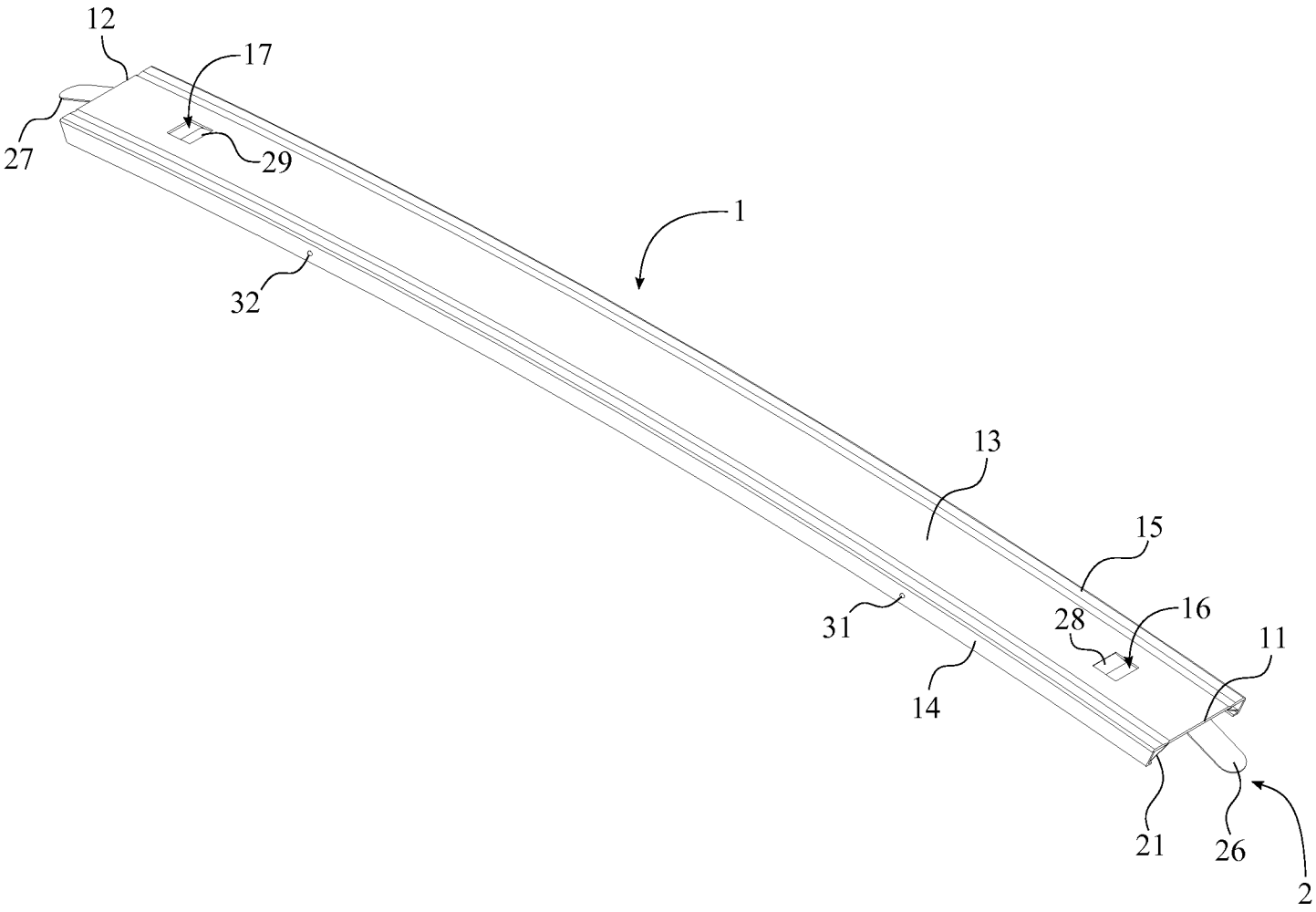
FIG. 1 is a perspective view of the present invention, showing the curved outer strip.
Figure 2:
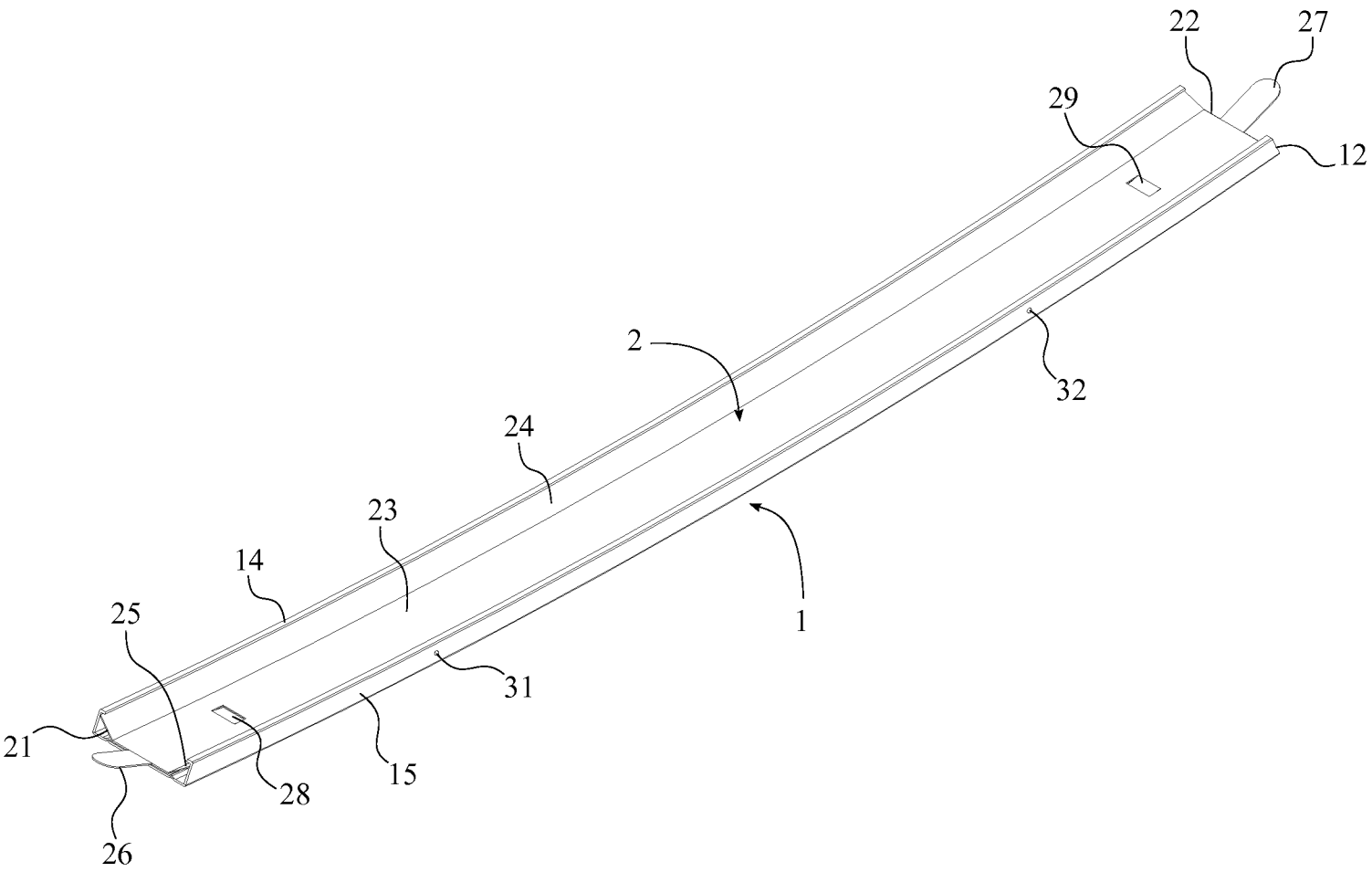
FIG. 2 is a perspective view of the present invention, showing the curved inner strip.
Figure 3:
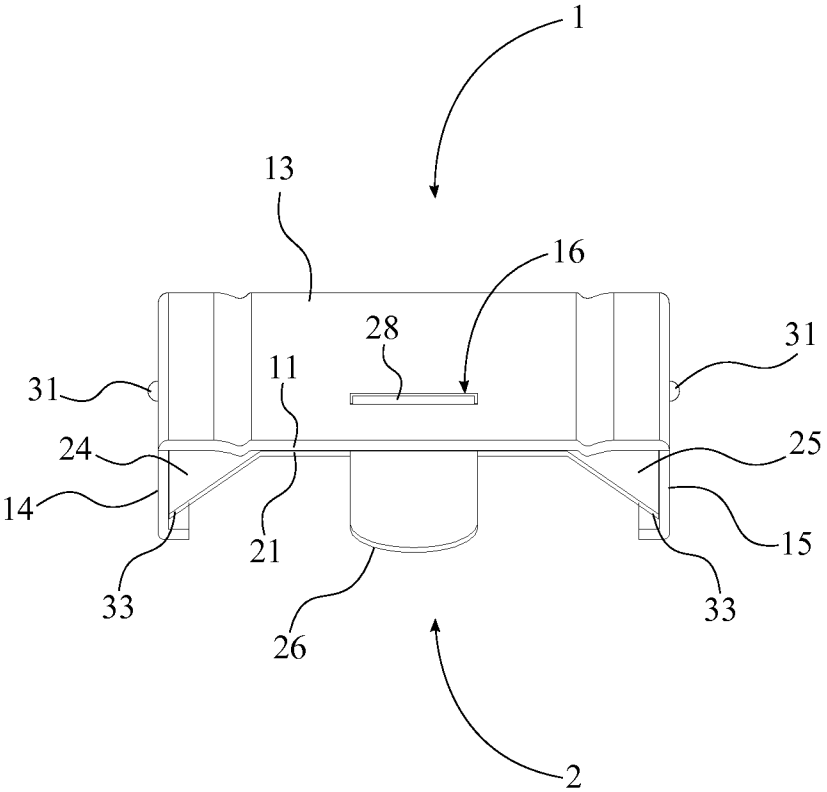
FIG. 3 is a side view of the present invention, showing the first end of the curved outer strip.
Figure 4:
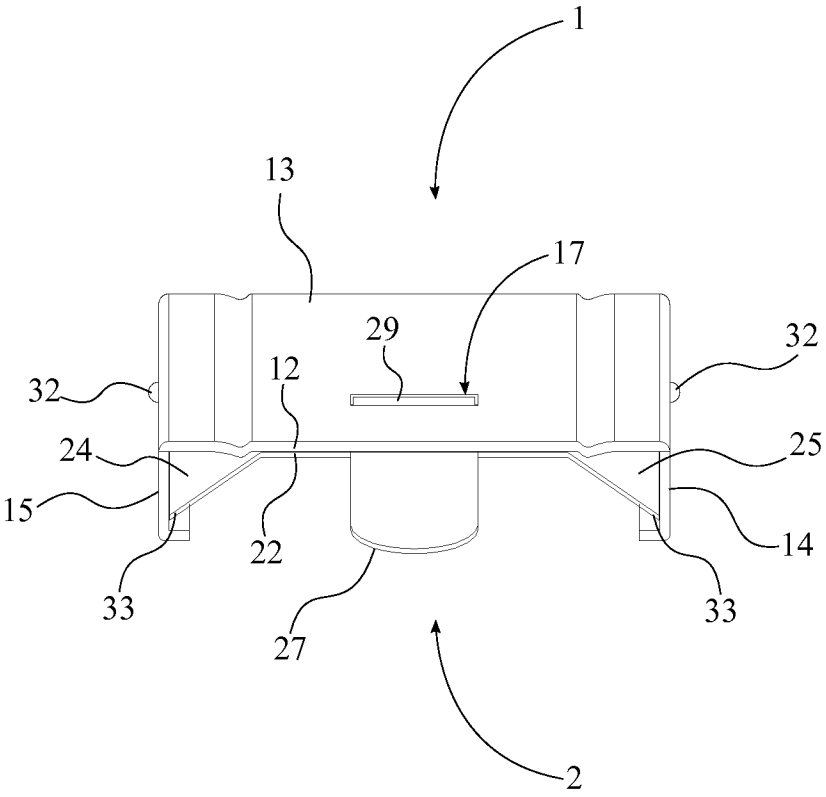
FIG. 4 is a side view of the present invention, showing the second end of the curved outer strip.
Figure 5:
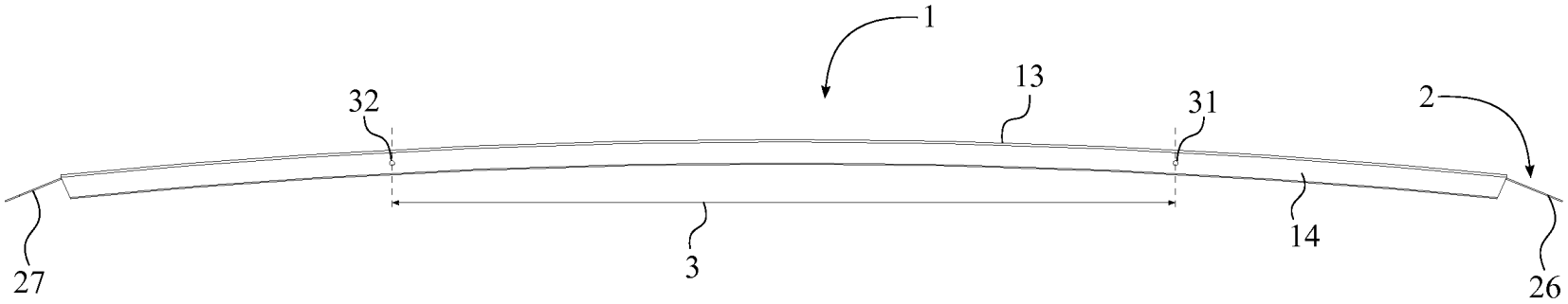
FIG. 5 is a side view of the present invention, showing the left rail of the curved outer strip.
Figure 6:
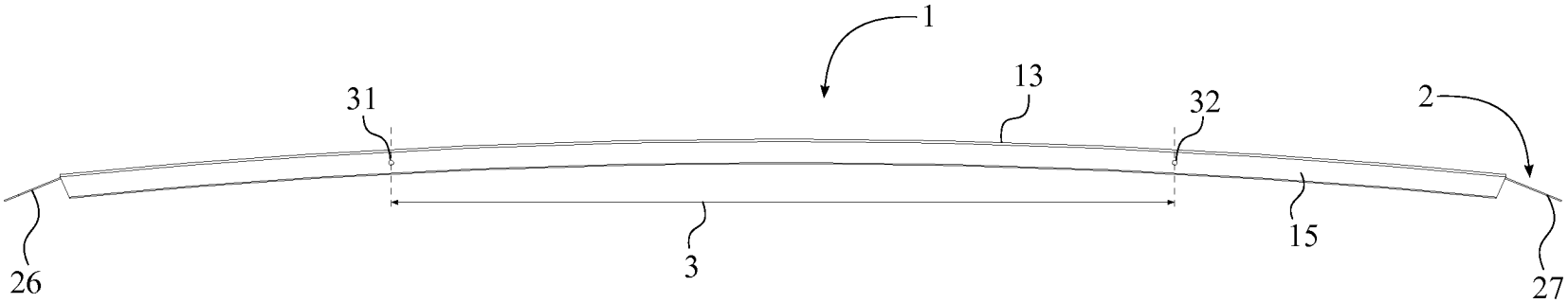
FIG. 6 is a side view of the present invention, showing the right rail of the curved outer strip.
Figure 7:
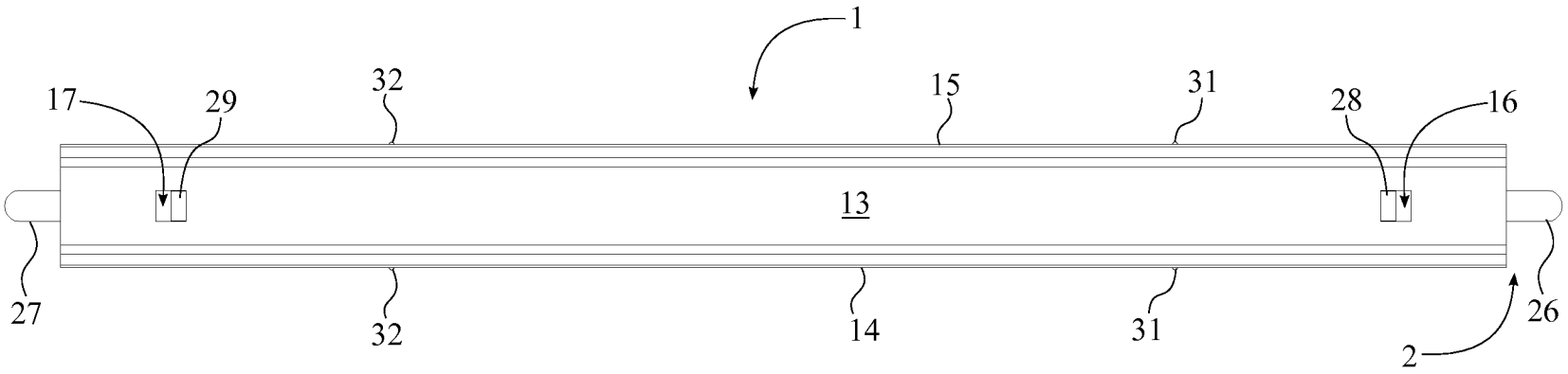
FIG. 7 is a top view of the present invention, showing the curved outer strip.
Figure 8:
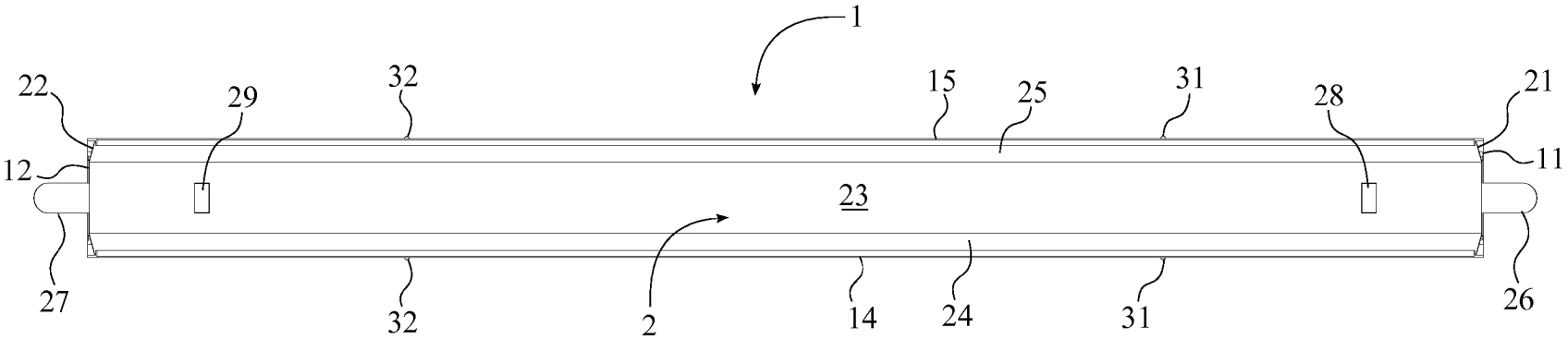
FIG. 8 is a bottom view of the present invention, showing the curved inner strip.
Figure 9:
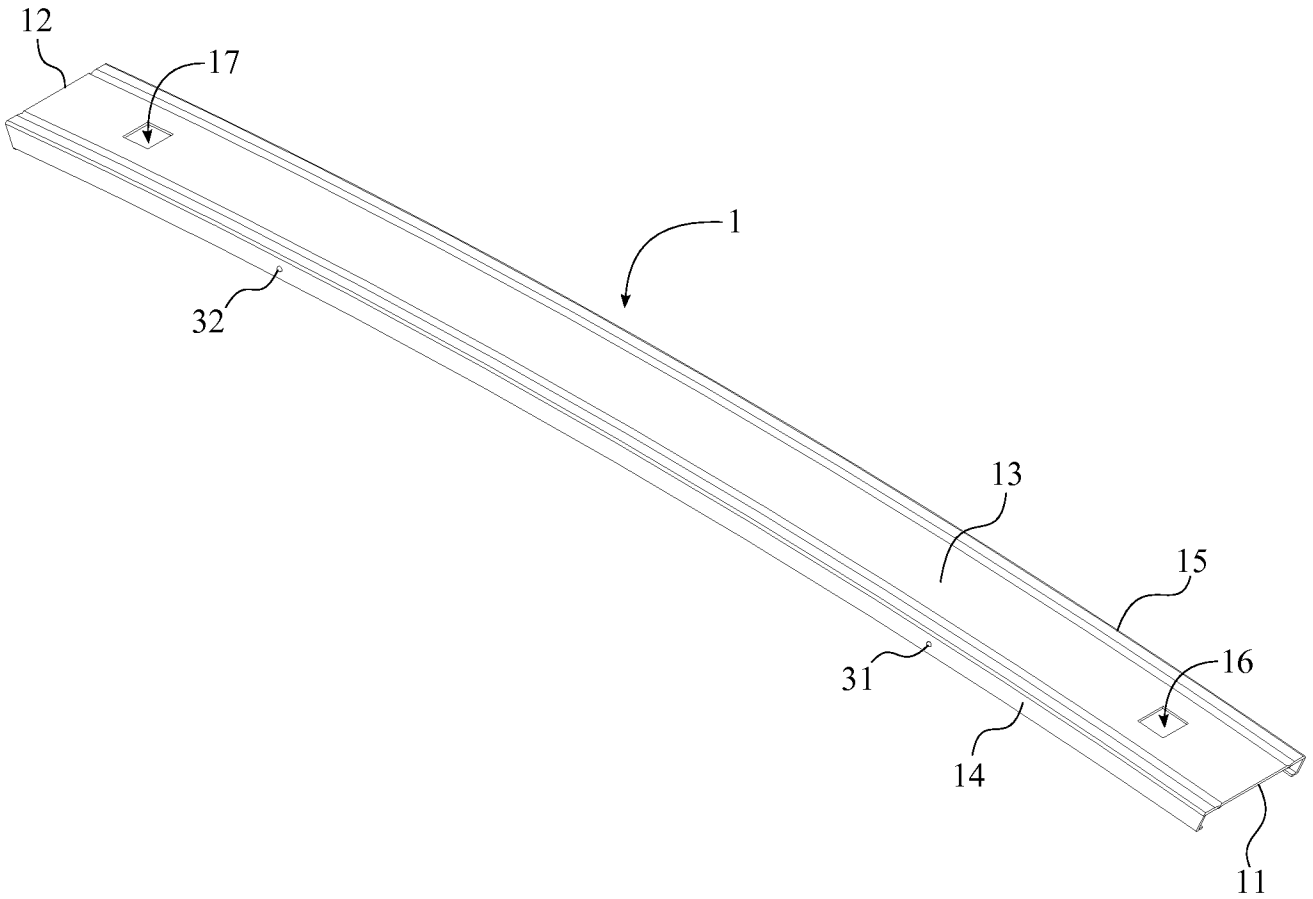
FIG. 9 is a perspective view of the curved outer strip.
Figure 10:
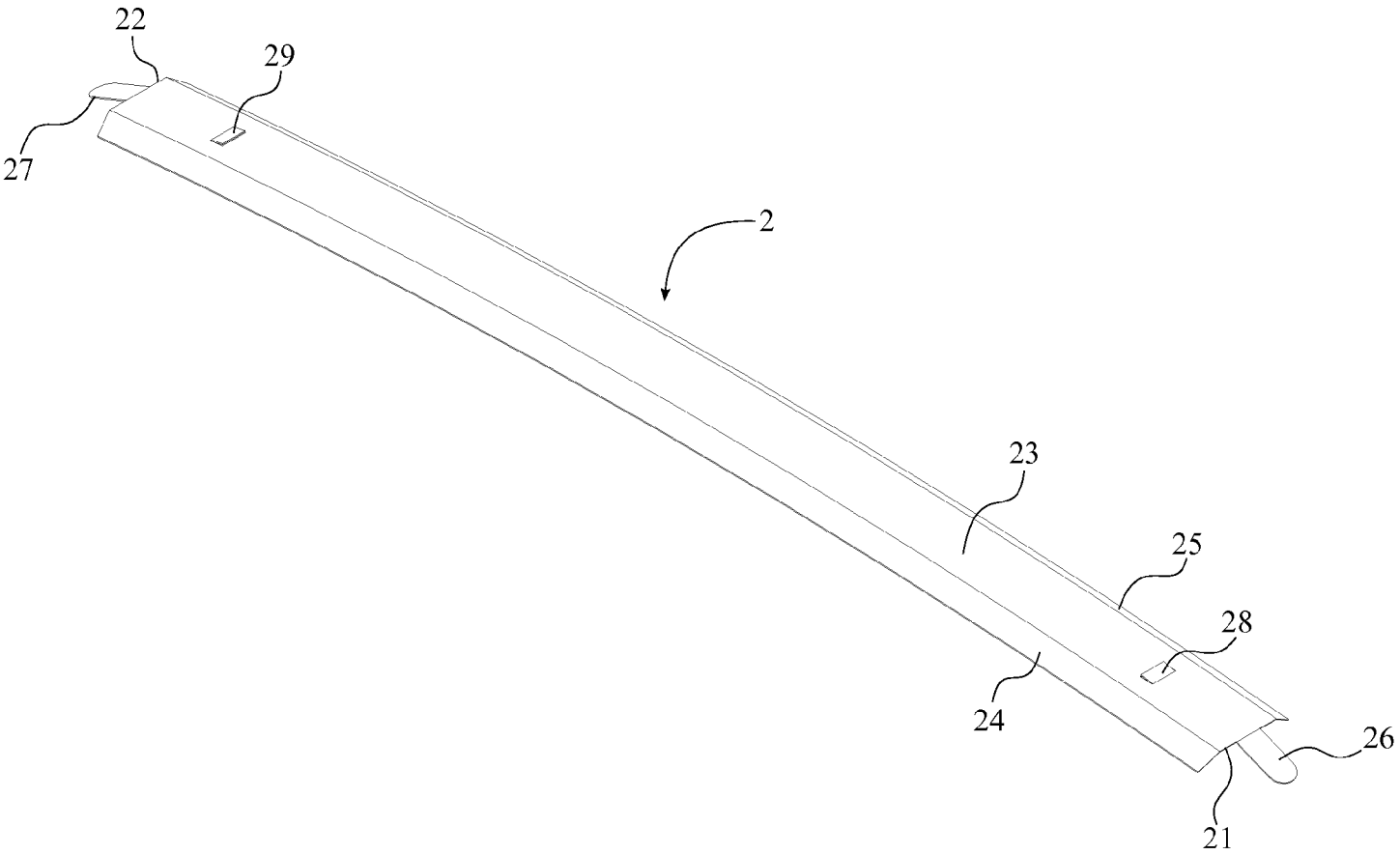
FIG. 10 is a perspective view of the curved inner strip.

The present invention is an apparatus for facilitating rapid loading of cartridges into a firearm box magazine. In reference to FIG. 1 and FIG. 2, the present invention comprises a curved outer strip 1 and a curved inner strip 2, where the curved inner strip 2 is adjacently connected with the curved outer strip 1 in such way that the curved inner strip 2 is adjacently positioned along the curved outer strip 1. In its preferred embodiment, the present invention is intended for use with 5.56×45 mm NATO rifle cartridges as well as Draft Standardization Agreement (STANAG) magazines as the present invention accommodates up to and including fifteen 5.56×45 mm NATO rifle cartridges. Additionally, the present invention may be utilized in conjunction with a guide tool.

In reference to FIG. 1-FIG. 9, the curved outer strip 1 comprises a first end 11, a second end 12, an elongated base 13, a left rail 14, a right rail 15, a first opening 16, and a second opening 17. The first end 11 is oppositely positioned from the second end 12 along the curved outer strip 1 in such way that the curved outer strip 1 forms a slight crescent shape from the first end 11 to the second end 12. The left rail 14 is adjacently connected to along the elongated base 13, and the right rail 15 is also adjacently connected along the elongated base 13 opposite of the left rail 14. The left rail 14 and the right rail 15 are positioned approximately perpendicular to the elongated base 13, where the left rail 14, the elongated base 13, and the right rail 15 are extended from the first end 11 to the second end 12. The left rail 14 and the right rail 15 secure the loaded rifle cartridges within the present invention as the rim of each loaded rifle cartridges is positioned within the left rail 14 and the right rail 15. The left rail 14 and the right rail 15 each comprise a first bulge 31 and a second bulge 32. The first bulge 31 of the left rail 14 is externally connected on the left rail 14 adjacent to the first end 11 while the second bulge 32 of the left rail 14 is externally connected on the left rail 14 adjacent to the second end 12. Similarly, the first bulge 31 of the right rail 15 is externally connected on the right rail 15 adjacent to the first end 11 while the second bulge 32 of the right rail 15 is externally connected on the right rail 15 adjacent to the second end 12. Additionally, the first bulge 31 of the left rail 14 is linearly positioned with the first bulge 31 of the right rail 15, and the second bulge 32 of the left rail 14 is linearly positioned with the second bulge 32 of the right rail 15. In reference to FIG. 5 and FIG. 6, an arc chord 3 of the present invention extends from the first bulge 31 to the second bulge 32 along the left rail 14 and the right rail 15, where the arc chord of the present invention is 81 millimeters. The first bulges 31 or the second bulges 32 of the curved outer strip 1 function together so that the curved outer strip 1 is able to engage with the guide tool. More specifically, if the present invention is engaged with the guide tool from the first end 11, the first bulges 31 control the depth that the curved outer strip 1 may insert into the guide tool. If the present invention is engaged with the guide tool from the second end 12, the second bulges 32 control the depth that the curved outer strip 1 may insert into the guide tool. The first opening 16 and the second opening 17 are traversed through the elongated base 13, where the first opening 16 is adjacently positioned with the first end 11, and the second opening 17 is adjacently positioned with the second end 12.

In reference to FIG. 1-FIG. 8 and FIG. 10, the curved inner strip 2 comprises a first extremity 21, a second extremity 22, a central segment 23, a left segment 24, a right segment 25, a first extended tab 26, a second extended tab 27, a first retaining tab 28, and a second retaining tab 29. The first extremity 21 and the second extremity 22 are oppositely positioned from each other along the curved inner strip 2, where the curved inner strip 2 is approximately the same length as the curved outer strip 1. The left segment 24 is adjacently connected along the central segment 23, and the right segment 25 is adjacently connected along the central segment 23 opposite of the left segment 24. Additionally, the left segment 24 and the right segment 25 are angularly positioned with the central segment 23 in such way that the left segment 24 and the right segment 25 extend towards the same direction. The first extended tab 26 is adjacently connected to the first extremity 21, and the second extended tab 27 is adjacently connected to the second extremity 22 so that the first extended tab 26 and the second extended tab 27 are able to oppositely position from each other. The first extended tab 26 and the second extended tab 27 are somewhat flexible and utilized to prevent the loaded rifle cartridges from slipping out of the present invention. The first retaining tab 28 is connected with the central segment 23 adjacent to the first extremity 21, and the second retaining tab 29 is connected with the central segment 23 adjacent to the second extremity 22. The first retaining tab 28 and the second retaining tab 29 are oppositely extended from the left segment 24 and the right segment 25 and sized approximately the same as the first opening 16 and the second opening 17.

In reference to FIG. 1-FIG. 4 and FIG. 7-FIG. 8, when the curved inner strip 2 is centrally connected with the curved outer strip 1, the central segment 23 is adjacently positioned on the elongated base 13 in such way that the left segment 24 and the right segment 25 are respectively positioned within the left rail 14 and the right rail 15. More specifically, a distal edge 33 of the left segment 24 is adjacently engaged with the left rail 14, and a distal edge 33 of the right segment 25 is adjacently engaged with the right rail 15. The configurations of the left rail 14, the right rail 15, the left segment 24, and the right segment 25 create two secure connections in between the curved outer strip 1 and the curved inner strip 2. Additionally, the first retaining tab 28 is connected with the first opening 16, and the second retaining tab 29 is connected with the second opening 17. In reference to FIG. 3 and FIG. 4, the first retaining tab 28 and the second retaining tab 29 are slightly protruded from the first opening 16 and the second opening 17 respectively. The first retaining tab 28 and the second retaining tab 29 prevent the curved inner strip 2 from sliding within the curved outer strip 1. As a result, the first extremity 21 is able to adjacently position with the first end 11, and the second extremity 22 is able to adjacently position with the second end 12.

Figure 11:
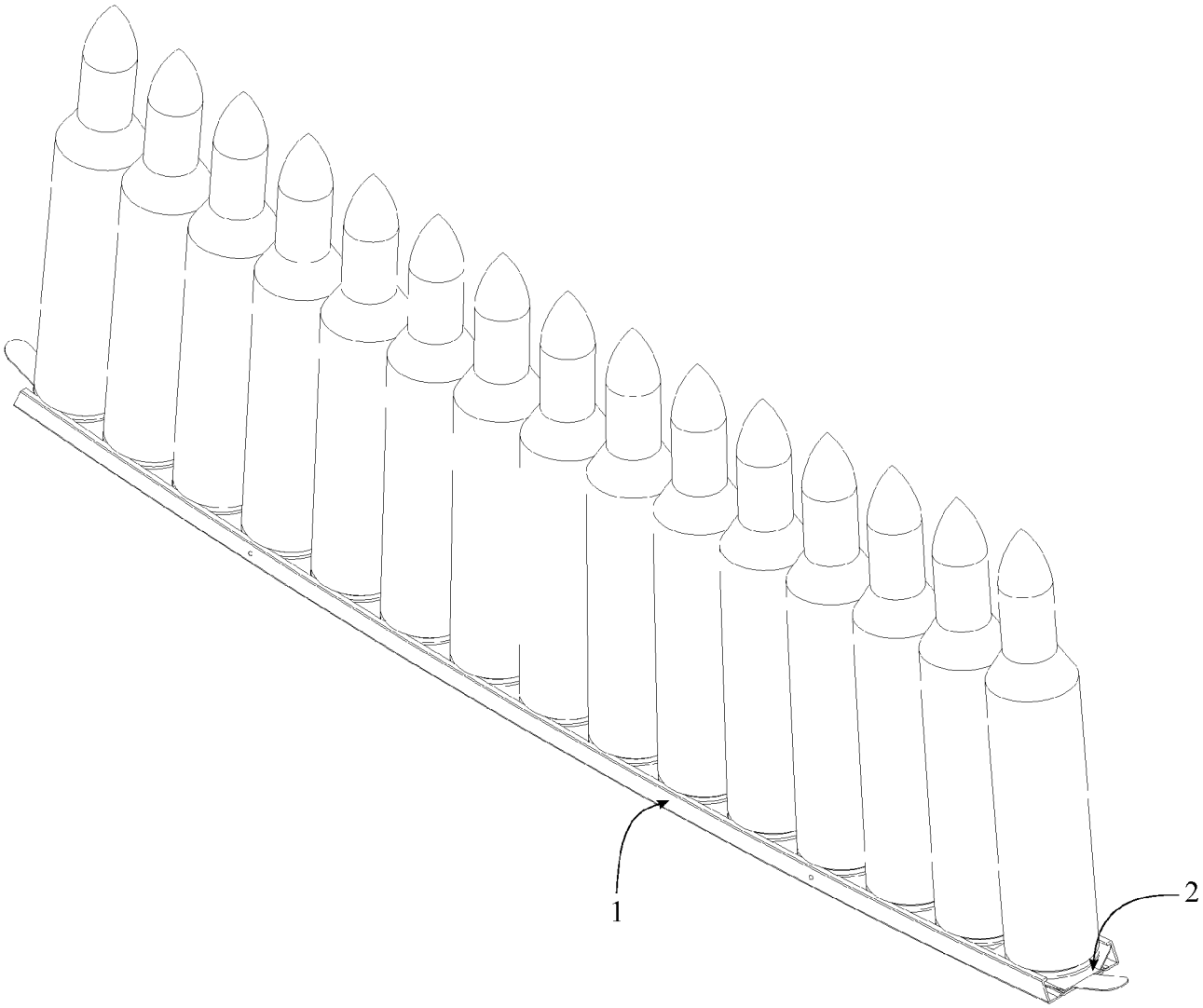
FIG. 11 is a perspective view of the present invention with fifteen rifle cartridges.

The object of the present invention is to facilitate and expedite the process of loading 5.56×45 mm NATO rifle cartridges into STANAG magazines that are compatible with a large number of service rifles and other firearms. Because the standard capacity of a STANAG magazine is twenty or thirty cartridges, it is often time-consuming to manually load cartridges one at a time. Additionally, difficulties may arise due to the resistance provided by high spring pressure forcing cartridges to the top of magazine. In reference to FIG. 11, the present invention is capable of holding up to and including fifteen rifle cartridges for loading into the magazine so that the rifle cartridge loading process can be efficient. Prior to use, the present invention is loaded with a number of rifle cartridges by sliding the rifle cartridge rims into a pair of recess tracks, where a left recess track of the pair of recess tracks is formed in between the left rail 14 and the left segment 24, and a right recess track of the pair of recess track is formed in between the right rail 15 and the right segment 25.

The pair of recess tracks allows the rifle cartridges to move freely along the length of the present invention. After the rifle cartridges are loaded onto the present invention, the guide tool is slotted onto a STANAG magazine. The guide tool features a rail that is sized to accommodate the present invention. Then the present invention is slotted into the rail of the guide tool. This positions and orients the rifle cartridges in the correct manner for loading into the magazine. From this position, the user is able to manually apply pressure on the rifle cartridges in a downward direction. The downward pressure causes the rifle cartridges to slide along the length of the present invention and into the magazine. The guide tool depresses the top rifle cartridge in the magazine in order to reduce the amount of pressure required to load the next rifle cartridge into the magazine. After the final rifle cartridge has been loaded into the magazine, the present invention and the guide tool are removed from the magazine.

Although the invention has been explained in relation to its preferred embodiment, it is to be understood that many other possible modifications and variations can be made without departing from the spirit and scope of the invention as hereinafter claimed.

What is claimed is:

1. An apparatus configured for facilitating rapid loading of cartridges into a firearm magazine comprises:

a curved outer strip;

a curved inner strip;

the curved outer strip comprises a first end, a second end, an elongated base, a left rail, a right rail, a first opening, and a second opening;

the left rail and the right rail each comprise a first bulge and a second bulge;

the curved inner strip comprises a first extremity, a second extremity, a central segment, a left segment, a right segment, a first extended tab, a second extended tab, a first retaining tab, and a second retaining tab;

the curved inner strip being adjacently positioned along the curved outer strip; and the curved inner strip being centrally connected with the curved outer strip configured to accommodate 1 to 15 rifle cartridges;

the first opening traversing through the elongated base;

the first opening being adjacently positioned with the first end;

the second opening traversing through the elongated base;

the second opening being adjacently positioned with the second end;

the first bulge of the left rail being externally connected on the left rail adjacent to the first end;

the second bulge of the left rail being externally connected on the left rail adjacent to the second end;

the first bulge of the right rail being externally connected on the right rail adjacent to the first end; the second bulge of the right rail being externally connected on the right rail adjacent to the second end;

the first bulge of the left rail being linearly positioned with the first bulge of the right rail;

the second bulge of the left rail being linearly positioned with the second bulge of the right rail;

an arc chord being extended along the left rail and the right rail from the first bulge to the second bulge; and the arc chord being 81 millimeters.

2. The apparatus for facilitating rapid loading of cartridges into a firearm magazine as claimed in claim 1 comprises:

the first end being oppositely positioned from the second end along the curved outer strip;

the first extremity being oppositely positioned from the second extremity along the curved inner strip;

the first extremity being adjacently positioned with the first end; and the second extremity being adjacently positioned with the second end.

3. The apparatus for facilitating rapid loading of cartridges into a firearm magazine as claimed in claim 1 comprises:

the left rail being adjacently connected along the elongated base;

the right rail being adjacently connected along the elongated base opposite of the left rail; and the left rail, the elongated base, and the right rail being extended from the first end to the second end.

4. The apparatus for facilitating rapid loading of cartridges into a firearm magazine as claimed in claim 1 comprises:

the left segment being adjacently connected along the central segment;

the right segment being adjacently connected along the central segment opposite of the left segment; and the left segment and the right segment being angularly positioned with the central segment.

5. The apparatus for facilitating rapid loading of cartridges into a firearm magazine as claimed in claim 1 comprises:

the first extended tab being adjacently connected to the first extremity;

the second extended tab being adjacently connected to the second extremity;

the first retaining tab being connected with the central segment adjacent to the first extremity;

the second retaining tab being connected with the central segment adjacent to the second extremity; and the first retaining tab and the second retaining tab being oppositely oriented from the left segment and the right segment.

6. The apparatus for facilitating rapid loading of cartridges into a firearm magazine as claimed in claim 1 comprises:

the central segment being adjacently positioned on the elongated base;

a distal edge of the left segment being adjacently engaged with the left rail;

a distal edge of the right segment being adjacently engaged with the right rail;

the first retaining tab being connected with the first opening; and the second retaining tab being connected with the second opening.

7. An apparatus configured for facilitating rapid loading of cartridges into a firearm magazine comprises:

a curved outer strip;

a curved inner strip;

the curved outer strip comprises a first end, a second end, an elongated base, a left rail, a right rail, a first opening, and a second opening;

the left rail and the right rail each comprise a first bulge and a second bulge;

the curved inner strip comprises a first extremity, a second extremity, a central segment, a left segment, a right segment, a first extended tab, a second extended tab, a first retaining tab, and a second retaining tab;

the curved inner strip being adjacently positioned along the curved outer strip;

the curved inner strip being centrally connected with the curved outer strip configured to accommodate 1 to 15 rifle cartridges;

the first end being oppositely positioned from the second end along the curved outer strip;

the first extremity being oppositely positioned from the second extremity along the curved inner strip;

the first extremity being adjacently positioned with the first end; and the second extremity being adjacently positioned with the second end;

the first opening traversing through the elongated base;

the first opening being adjacently positioned with the first end;

the second opening traversing through the elongated base;

the second opening being adjacently positioned with the second end;

the first bulge of the left rail being externally connected on the left rail adjacent to the first end;

the second bulge of the left rail being externally connected on the left rail adjacent to the second end;

the first bulge of the right rail being externally connected on the right rail adjacent to the first end;

the second bulge of the right rail being externally connected on the right rail adjacent to the second end;

the first bulge of the left rail being linearly positioned with the first bulge of the right rail;

the second bulge of the left rail being linearly positioned with the second bulge of the right rail;

an arc chord being extended along the left rail and the right rail from the first bulge to the second bulge; and the arc chord being 81 millimeters.

8. The apparatus for facilitating rapid loading of cartridges into a firearm magazine as claimed in claim 7 comprises:

the left rail being adjacently connected along the elongated base;

the right rail being adjacently connected along the elongated base opposite of the left rail; and the left rail, the elongated base, and the right rail being extended from the first end to the second end.

9. The apparatus for facilitating rapid loading of cartridges into a firearm magazine as claimed in claim 7 comprises:

the left segment being adjacently connected along the central segment;

the right segment being adjacently connected along the central segment opposite of the left segment; and the left segment and the right segment being angularly positioned with the central segment.

10. The apparatus for facilitating rapid loading of cartridges into a firearm magazine as claimed in claim 7 comprises:

the first extended tab being adjacently connected to the first extremity;

the second extended tab being adjacently connected to the second extremity;

the first retaining tab being connected with the central segment adjacent to the first extremity;

the second retaining tab being connected with the central segment adjacent to the second extremity; and the first retaining tab and the second retaining tab being oppositely oriented from the left segment and the right segment.

11. The apparatus for facilitating rapid loading of cartridges into a firearm magazine as claimed in claim 7 comprises:

the central segment being adjacently positioned on the elongated base;

a distal edge of the left segment being adjacently engaged with the left rail;

a distal edge of the right segment being adjacently engaged with the right rail;

the first retaining tab being connected with the first opening; and the second retaining tab being connected with the second opening.

12. An apparatus configured for facilitating rapid loading of cartridges into a firearm magazine comprises:

a curved outer strip;

a curved inner strip;

the curved outer strip comprises a first end, a second end, an elongated base, a left rail, a right rail, a first opening, and a second opening;

the left rail and the right rail each comprise a first bulge and a second bulge;

the curved inner strip comprises a first extremity, a second extremity, a central segment, a left segment, a right segment, a first extended tab, a second extended tab, a first retaining tab, and a second retaining tab;

the curved inner strip being adjacently positioned along the curved outer strip;

the curved inner strip being centrally connected with the curved outer strip configured to accommodate 1 to 15 rifle cartridges;

the first end being oppositely positioned from the second end along the curved outer strip;

the first extremity being oppositely positioned from the second extremity along the curved inner strip;

the first extremity being adjacently positioned with the first end;

the second extremity being adjacently positioned with the second end;

the first extended tab being adjacently connected to the first extremity; and the second extended tab being adjacently connected to the second extremity;

the first opening traversing through the elongated base;

the first opening being adjacently positioned with the first end;

the second opening traversing through the elongated base;

the second opening being adjacently positioned with the second end;

the first bulge of the left rail being externally connected on the left rail adjacent to the first end;

the second bulge of the left rail being externally connected on the left rail adjacent to the second end;

the first bulge of the right rail being externally connected on the right rail adjacent to the first end;

the second bulge of the right rail being externally connected on the right rail adjacent to the second end;

the first bulge of the left rail being linearly positioned with the first bulge of the right rail;

the second bulge of the left rail being linearly positioned with the second bulge of the right rail;

an arc chord being extended along the left rail and the right rail from the first bulge to the second bulge; and the arc chord being 81 millimeters.

13. The apparatus for facilitating rapid loading of cartridges into a firearm magazine as claimed in claim 12 comprises:

the left rail being adjacently connected along the elongated base;

the right rail being adjacently connected along the elongated base opposite of the left rail; and the left rail, the elongated base, and the right rail being extended from the first end to the second end.

14. The apparatus for facilitating rapid loading of cartridges into a firearm magazine as claimed in claim 12 comprises:

the left segment being adjacently connected along the central segment;

the right segment being adjacently connected along the central segment opposite of the left segment; and the left segment and the right segment being angularly positioned with the central segment.

15. The apparatus for facilitating rapid loading of cartridges into a firearm magazine as claimed in claim 12 comprises:

the first retaining tab being connected with the central segment adjacent to the first extremity;

the second retaining tab being connected with the central segment adjacent to the second extremity; and the first retaining tab and the second retaining tab being oppositely extended from the left segment and the right segment.

16. The apparatus for facilitating rapid loading of cartridges into a firearm magazine as claimed in claim 12 comprises:

the central segment being adjacently positioned on the elongated base;

a distal edge of the left segment being adjacently engaged with the left rail;

a distal edge of the right segment being adjacently engaged with the right rail;

the first retaining tab being connected with the first opening; and the second retaining tab being connected with the second opening.

* * * * *